United States Patent [19]

Kyoung et al.

[11] Patent Number: 4,745,859

[45] Date of Patent: May 24, 1988

[54] APPARATUS FOR REPELLING BIRDS OR BEASTS

[76] Inventors: Kim M. Kyoung, 7-101 Jangmi Apt. 530-3, Seryu-dong; Suwon City; Chung K. Hong, 6-23 Youkchon-dong Eonpyoung-gu, Seoul, both of Rep. of Korea

[21] Appl. No.: 370

[22] Filed: Jan. 5, 1987

[30] Foreign Application Priority Data

Jan. 6, 1986 [KR] Rep. of Korea ..... 86-7[U]

[51] Int. Cl.[4] ..... F41F 27/00; G08B 3/14

[52] U.S. Cl. ..... 102/293; 42/106; 116/22 A; 116/23

[58] Field of Search ..... 42/57, 106; 102/293, 102/361; 116/22 A, 23

[56] References Cited

U.S. PATENT DOCUMENTS 952,018 3/1910 Roeder ..... 42/106
2,836,919 6/1958 Du Bois ..... 42/57
2,920,600 1/1960 Hori et al. ..... 116/22 A
2,958,150 11/1960 Du Bois ..... 42/57

*Primary Examiner*—Charles T. Jordan
*Attorney, Agent, or Firm*—Saidman, Sterne, Kessler & Goldstein

[57] ABSTRACT

An apparatus for repelling birds or beasts by exploding gunpowder automatically and repeatedly to make explosive sounds. The apparatus comprises a housing, a body plate on which most of other parts of the apparatus are mounted, an electric motor, a disk-like gear mechanically connected to the electric motor via reduction gears, a gunpowder striking hammer and a driving link, respectively, rotatably secured to the body plate and being actuated by the rotation of the disk-like gear, a gunpowder supply plate driven by the driving link, a gunpowder band winding spool, a bottom plate for placing the gunpowder band, and a switch assembly operated by the rotation of disk-like gear and electrically connected with a timer, a dry cell battery, and the electric motor.

3 Claims, 4 Drawing Sheets

APPARATUS FOR REPELLING BIRDS OR BEASTS

TECHNICAL FIELD

The present invention relates to an apparatus for repelling birds or beasts and, more particularly, to an apparatus which automatically and repeatedly explodes gunpowder to make explosive sounds so as to drive or beasts away from the farm.

BACKGROUND OF THE INVENTION

The intrusions of such birds as sparrows or feral beasts into paddy fields, dry fields, orchards or other cultivated land for certain kinds of crops during fruition or harvest season result in tremendous losses to the crops.

In the past, it has been the conventional practice to employ scarecrows or light reflecting tapes in order to make the birds or beasts frightened and to prevent their approach to the farm. However, those methods have turned out to be unsatisfactory.

It is also known in this art to make explosive sounds by means of toy pistol or any other exploding means to repel birds or beasts from the farm. However, difficulties and problems have been encountered when employing exploding means such as toy pistol or toy gun which stem largely from the fact that men must carry the exploding means with them and charge and explode the gunpowder one by one.

In addition to being dangerous and inconvenient, this method did not save farmers' labor greatly. Further, when using the above method, it is particularly inconvenient to stay on the farm at night in order to drive away the nocturnal animals.

Therefore, it is an object of the present invention to provide a novel and improved apparatus for exploding gunpowder automatically and repeatedly for repelling birds or beasts which is very convenient and inexpensive, and does not require farmers to stay on the farm wasting time.

SUMMARY OF THE INVENTION

The apparatus in accordance with the present invention comprises: a body plate on which other parts of the apparatus are mounted; a cover plate assembled with the body plate; an electric motor secured to the body plate; a disk-like gear mechanically connected to the said electric motor and having pin bosses thereon; a gunpowder striking hammer rotatably secured to the body plate and being urged by a spring attached to the body plate, the shank of the striking hammer cooperating with the pin bosses on the disk-like gear; a driving link rotatably secured to the body plate and being urged by a spring attached to the body plate, the driving link cooperating with the pin bosses on the disk-like gear; a gunpowder supply plate engaged at the rear end thereof with the driving link and being rotatably connected at the frontal end with a gunpowder push plate; a bottom plate attached along to the bottom side of the body plate; a switch assembly provided with a switch lever extending up to the upper portion of the disk-like gear for cooperating with the pin bosses of the disk-like gear and with a switch button to be depressed by the switch lever; and a timer mounted on the electronic switching circuit plate which is electrically connected with the said switch, the electric motor and a dry cell battery.

The disk-like gear is driven by the motor to rotate, causing one of the pin bosses on the disk-like gear to raise the striking hammer against the urging of the spring and causing the other pin boss to rotate the driving link to drive the gunpowder supply plate and gunpowder push plate forward to push a gunpowder deposit on a gunpowder band into position to be struck by the gunpowder striking hammer. As the disk-like gear continues to rotate, the gunpowder striking hammer is released and the gunpowder supply plate and push plate retract. The head of the gunpowder striking hammer strikes the gunpowder deposit, exploding it. The disk-like gear continues to rotate such that one of the pin bosses acts on the switch lever to depress the switch button, thereby activating a timer which opens the circuit between the electric motor and the dry cell battery for a predetermined period of time. After the predetermined time has expired, the circuit between the electric motor and the dry cell battery is closed and the operation of the apparatus repeats. Thus the said apparatus can produce explosive sounds by exploding gunpowder automatically and repeatedly.

More detailed features and advantages of the present invention will become more apparent from the following description when taken in connection with the accompanying drawings which show, for purpose of illustration only, an embodiment in accordance with the present invention.

DETAILED DESCRIPTION OF THE INVENTION

Figure 1:
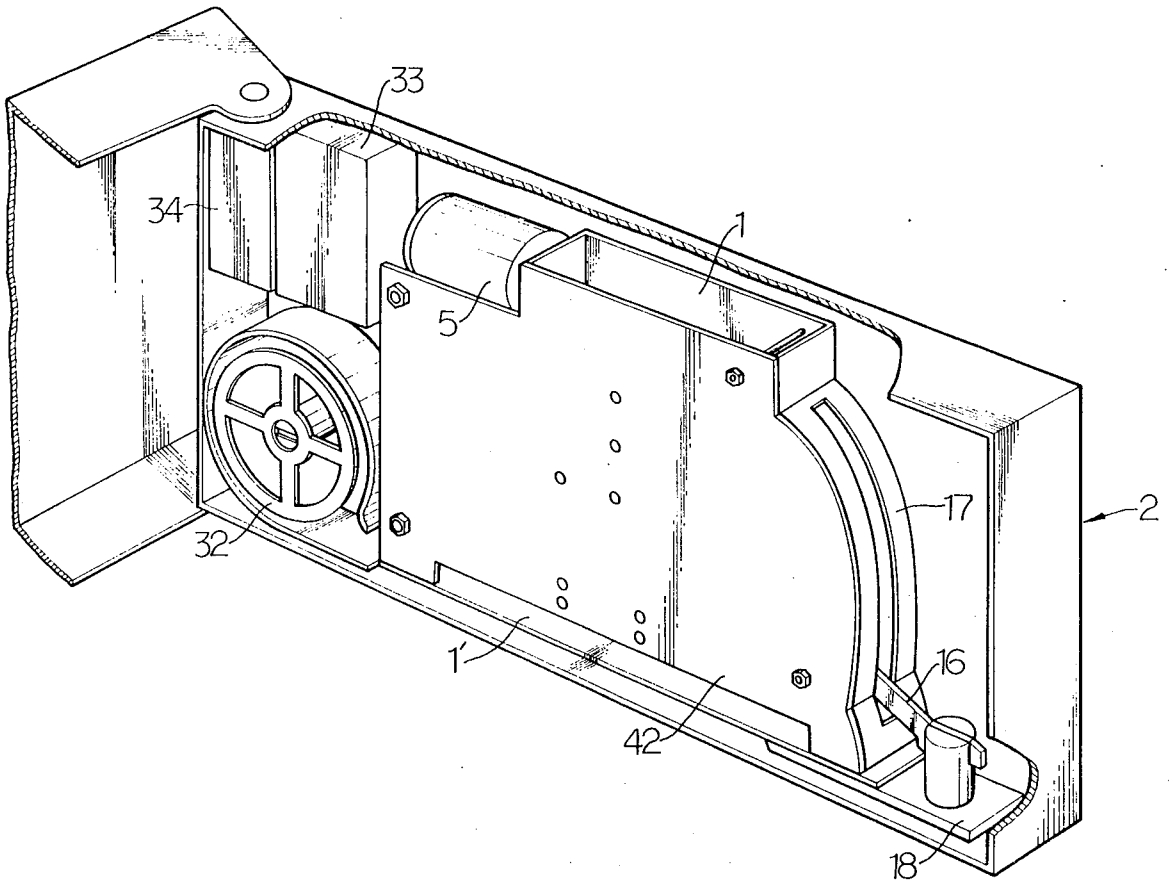
FIG. 1 is a perspective view of the apparatus in accordance with the present invention partially broken away.
Figure 2:
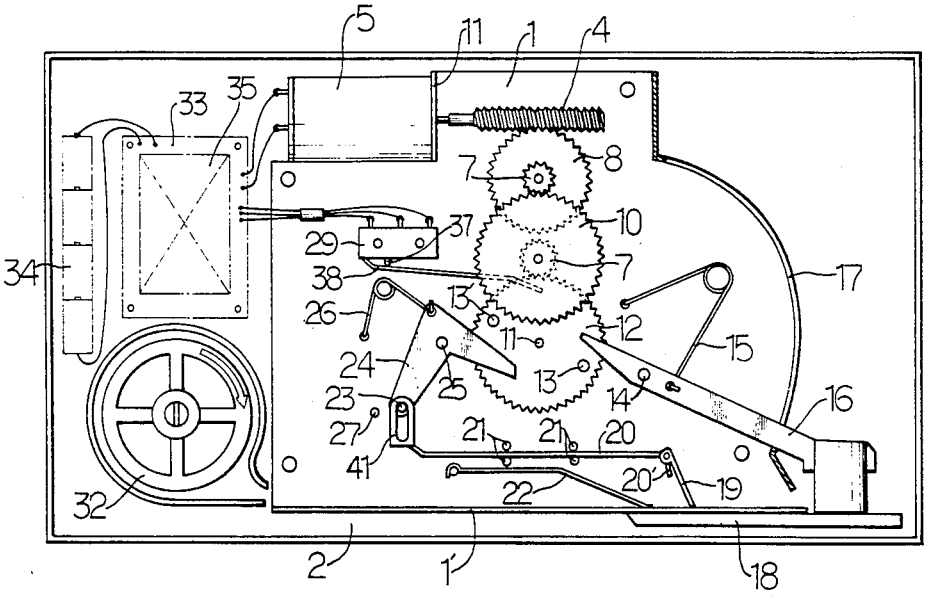
FIG. 2 is a front elevational view of the apparatus shown in FIG. 1 with the cover plate removed to illustrate the interior construction thereof.
Figure 3:
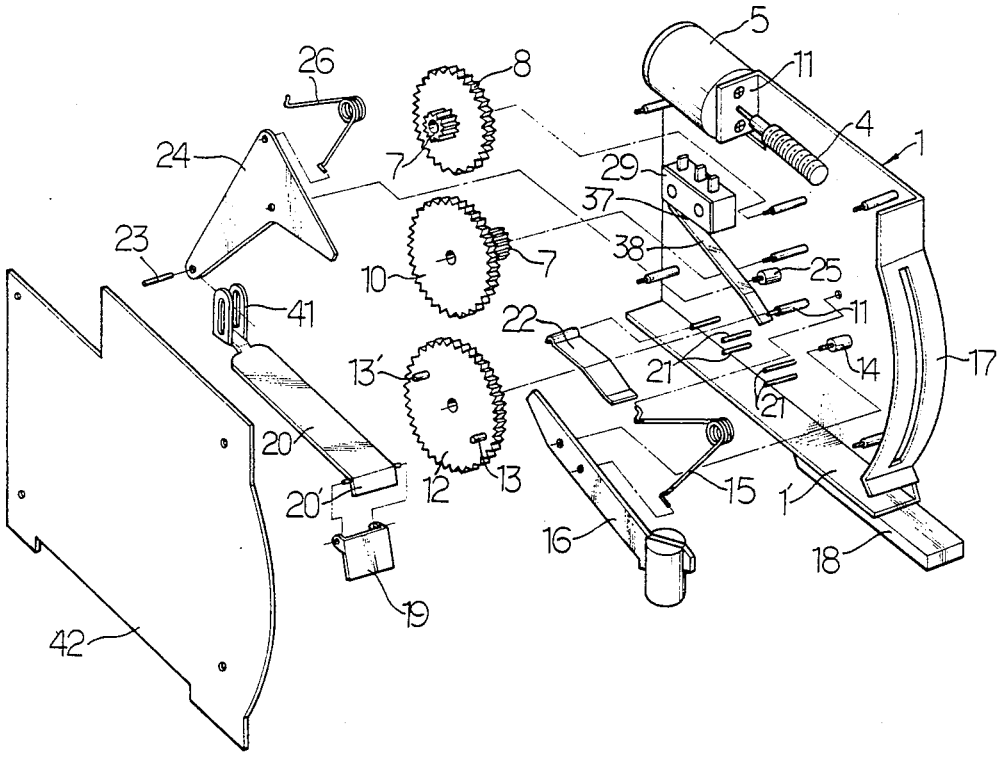
FIG. 3 is an exploded view of the apparatus shown in FIG. 1 with some parts thereof removed to better illustrate the interior construction thereof.
Figure 5:
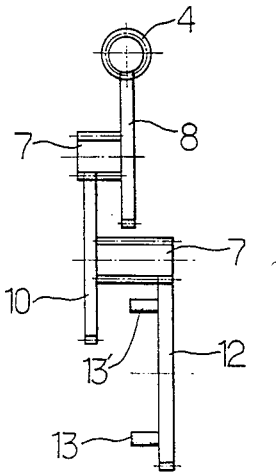
FIG. 5 is an diagrammatic side elevational view of the gears shown in FIG. 2.

Referring now to FIG. 1 to FIG. 3, the apparatus in accordance with the present invention for repelling birds or beasts includes a housing 2, body plate generaly designated as 1 on which most of other parts of the apparatus are mounted. An electric motor 5 as a power generating means, of which shaft is connected to a worm 4, is fixedly secured to a bracket 11 which is a vertically extending portion of the said body plate 1. The worm gear 8 engaged in teeth with the said worm 4 is, at its small gear portion 7, engaged with the intermediate reduction gear 10 which is, at its small portion, engaged with the disk-like gear 12 to which the rotation of the motor 5 is transferred at reduced speed and greater torque. Reference is made to FIG. 5 for more detailed illustration of combination of gears. On the periphery of the disk-like gear 12, a pair of opposite pin-type bosses 13, 13' are provided in order to actuate gunpowder striking hammer 16, the gunpowder supply plate driving link 24 and switch lever 38 upon rotation of the disk-like gear 12. Gunpowder striking hammer 16 is rotatably secured to the body plate 1 by means of pivot 14 so as for the end thereof to engage with one of the pin-type bosses 13, 13' of the disk-like gear 12 when disk-like gear 12 rotates. Gunpowder striking hammer is urged by a spring 15 having one end thereof attached to the body plate 1.

Figure 6:
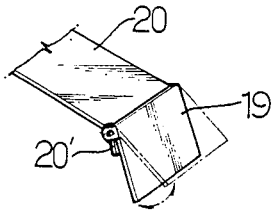
FIG. 6 is a perspective view of a gunpowder supply plate and push plate to illustrate the operations therebetween.

Gunpowder supply plate driving link 24 is in the shape of a "V" and is rotatably secured to the body plate 1 by means of pivot 25 so as for the one end thereof to engage with one of the pin-type bosses 13, 13' of the disk-like gear 12 when disk-like gear 12 rotates. Driving link 24 is urged by a spring 26 having one end therof attached to the body plate 1. Formed on the other end of the driving link 24 is a pin-type boss 23 which is slidably engaged with the vertically elongated hole 41 provided at the rear end of a gunpowder supply plate 20 so that the rotational movement of the driving link 24 can be converted into the reciprocal horizontal translation of the gunpowder supply plate 20. Gunpowder supply plate 20 is interposed between and guided by two pairs of opposed rollers 21 vertically and rotatably secured to the body plate 1, each pair of rollers being horizontally spaced apart with respect to each other so that the horizontal translation of the gunpowder supply plate 20 is facilitated. At the frontal end of the gunpowder supply plate 20 an integrally formed tongue 20' which is downwardly bent. As better illustrated in FIG. 6, rotatably connected to the frontal end of the gunpowder supply plate 20 is a push plate 19 which, upon backward rotation thereof, bears against the tongue 20' of the supply plate so that, when the free end thereof turns downward, the backward rotation of the push plate 19 is prevented, whereas forward rotation is freely effected. Therefore, the push plate 19 pushes forwards gunpowder band 47 (shown in FIG. 4) when the supply plate 20 is driven. Push plate 19 returns without moving the pushed gunpowder band as the supply plate 20 returns.

Below the rear end of the supply plate 20 there is provided a relatively resillient gunpowder band pressing plate 22 one end of which is attached to the body plate 1 in order to prevent the backward movement of the gunpowder band 47 when the supply plate 20 returns. In addition, a stopper 27 is fixedly secured to the body plate 1 so as to limit the backward movement of the gunpowder supply plate 20 and driving link 24. Connected to the right end portion of the bottom plate 1' is a thick base plate 18 in order to receive and place thereon the gunpowder deposits 46 on gunpowder band 47 supplied by the push plate 19 and to be struck by the gunpowder striking hammer 16.

Below the electric motor 5 on the body plate 1 there is provided a switch assembly 29, for controlling the supply of the electricity from the dry cell battery 34 to the electric motor 5, which includes a spring loaded push button 37 protruding beyond the bottom face thereof. Secured to the bottom face of the switch assembly 29 at its one end is a relatively resilient switch lever 38 which extends up to the upper portion of the disk-like gear 12 hanging below the said spring loaded switch button 37 so as to be urged upwards by one of the bosses 13, 13' upon rotation of the disk-like gear 12 and to depress the switch button. To the left of the upper portion of the body plate 1 there is provided a timer 35 mounted on the electronic switching circuit plate 35 which is electrically connected to the switch assembly 29, electric motor 5 and dry cell battery 34 in order to control the electric power supply from dry cell battery 34 to the motor 5.

A spool 32 is rotatably secured to the housing 2 of the apparatus to the left of the gunpowder supply plate 20 for winding the gunpowder band 47 which is to be unwound and supplied on to the base plate 18 by means of the push plate 19. Attached to the body plate 1 at the right side thereof is a shield plate 17 which is formed with an elongated aperture extending from nearly the lower end to the upper portion thereof for allowing the shank of hammer to slide therealong. Shield plate 17 is positioned so that not only the entrance of the fragment of the gunpowder into the inside of the apparatus but also the possible inward spread of the flame can be retarded. Cover plate 42 is assembled with the base plate 1 such that most of other parts of the apparatus placed between them.

Figure 4:
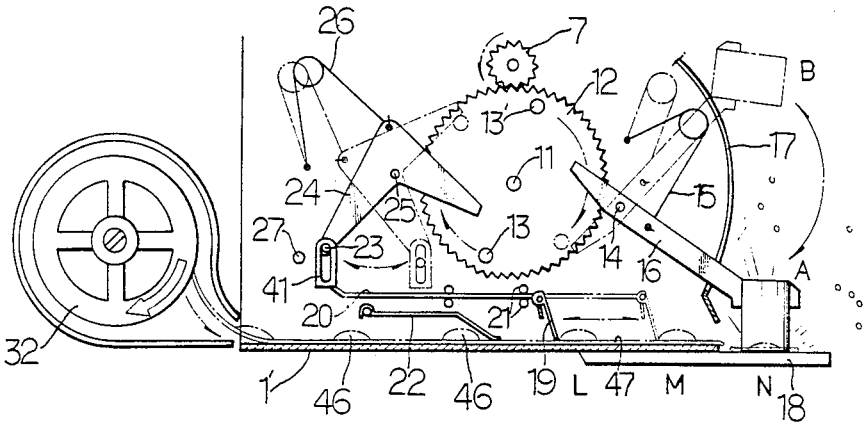
FIG. 4 is a fragmentary elevational view to illustrate the operation of the apparatus shown in FIG. 1.

Referring to FIG. 2 and FIG. 4, the operation of the apparatus in accordance with the present invention will be described in detail.

Upon the rotation of the disk-like gear 12 in the direction of arrows (clockwise) as shown in FIG. 4 by the torque transferred from the electric motor 5 via the intermediate reduction gears 8, 10, the pin-type boss 13 of the disk-like gear 12 rotates about the axis 11 of the disk-like gear 12 descending downward from its highest position and subsequently engaging with and pushing the end of the gunpowder striking hammer 16 shank so that the hammer is caused to rotate about the axis 14 having the hammer head lifted from the position "A" to "B".

Similarly, upon the rotation of the disk-like gear 12, the other boss 13' located opposite the boss 13 on the disk-like gear 12 simultaneously rotates and ascends fron its lowest position soon after engaging with and pushing upward one end of the driving link 24 and causing the driving link 24 to rotate about the axis 25 so that the pin-type boss 23 formed on the other end of the driving link 24 slides downward in the vertically elongated hole 41 formed at the rear end of the gunpowder supply plate 20 and subsequently pushes forward horizontally the gunpowder supply plate so as to have the gunpowder push plate 19 push forward the gunpowder deposits 46 stored successively on the gunpowder band 47 from the position "L" to "M" to "N".

When one of the gunpowders is supplied to the predetermined position "N", the striking hammer 16, the shank of which was in engagement with the boss 13 of the disk-like gear 12 at its end and the head of which was lifted to the highest position, is released from the engagement with the boss 13, the head of gunpowder striking hammer 16 moving downwardly to strike the gunpowder deposit 46 at position "N" on the base plate 18 by means of the urgency of the spring 15, thus exploding the gunpowder and making an explosive sound.

Soon after the explosion of the gunpowder, the driving link 24 is released from the engagement with the boss 13' at the one end thereof and returns to its initial position because of the urgency of the spring 26 thus simultaneously pulling backwards horizontally the gunpowder supply plate 20 together with the gunpowder push plate 19 so that the gunpowder push plate returns to the initial position without moving the gunpowder band. Gunpowder push plate 19 is thereby positioned to push the gunpowder band 47 forward again.

As the disk-like gear 12 continues to rotate, the pin-type boss 13' ascends and pushes upward the end of the switch lever 38 so that by means of the upward movement of the switch lever 38 the switch button 46 is depressed so as to cut the power supply to the electric motor 5 and simultaneously cause the timer 35 to operate for a predetermined time.

After the lapse of the predetermined time, the timer 35 causes the dry cell to be electrically connected to the motor 5 which operates the apparatus again.

Additionally, the apparatus in accordance with the present invention can be utilized in order to repel birds, animals or fur seals from an airport or fishing area.

While a particular embodiment of the present invention has been shown and described, it will be obvious to those skilled in the art that changes and modifications may be made without departing from the invention and, therefore, the aim in the appended claims is to cover all such changes and modifications as fall within the true spirit and scope of this invention.

What is claimed is:

1. An apparatus for repelling birds or beasts by exploding gunpowder deposits on a gunpowder band automatically and repeatedly to make explosive sounds, said apparatus comprising:

a housing;

a body plate attached within said housing;

a bottom plate attached along the bottom side of said body plate, said bottom plate for receiving the gunpowder band thereof;

a cover plate for said housing;

an electric motor secured to said body plate;

an intermediate reduction gear driven by said motor;

a disk-like gear driven by said intermediate reduction gear to rotate, said disk-like gear having pin-type bosses disposed on opposite sides of the periphery thereof;

a gun powder striking hammer having a shank and a head for striking the gunpowder deposits on the gunpowder band, said hammer secured to said body plate at a pivot point such that the free end of the shank engages with one of said bosses on said disk-like gear when said disk-like gear rotates to raise the head of said hammer, the shank and said pin-type boss disengaging as said disk-like gear continues to rotate, said hammer head being urged downward by a spring attached between said hammer and said body plate to strike a gunpowder deposit on said bottom plate;

a gunpowder supply plate for advancing the gunpowder band along said bottom plate, the rear end of said gunpowder supply plate being formed with a vertically elongated hole, and the front end of said gunpowder supply plate having a push plate connected by a hinge, said push plate extending forward and downward from said gunpowder supply plate toward said bottom plate, the forward edge of said push plate contacting said gunpowder band on said bottom plate such that when said gunpowder supply plate is driven forward, said gunpowder band is advanced;

a driving link for driving said gunpowder supply plate, said driving link secured to said body plate at a pivot point such that one end of said driving link engages with one of said pin-type bosses on said disk-like gear when said disk-like gear rotates, said driving link having formed at its other end a pin-type boss for engaging the elongated hole of said gunpowder supply plate, and said driving link being urged by a spring attached between said driving link and said body plate;

an electrical power source;

a timer for controlling the time between explosions, said timer electrically connected to said electrical power source and said motor;

a switch having an actuating switch lever for engaging with one of said pin-type bosses on said disk-like gear to actuate said switch, said switch electrically connected to said timer.

2. The apparatus of claim 1, wherein the front end of said gunpowder supply plate is integrally formed with a tongue which is downwardly bent, said tongue for permitting the said push plate to move in only one direction.

3. The apparatus of claim 1, further comprising a shield plate for shielding the interior of the apparatus from the explosions, said shield plate attached to said body plate at the forward side thereof, and said shield plate having an elongated aperture for allowing the shank of said hammer to swing.

* * * * *